US007561129B2

(12) United States Patent
Lee et al.

(10) Patent No.: US 7,561,129 B2
(45) Date of Patent: Jul. 14, 2009

(54) ORGANIC LIGHT-EMITTING DEVICE AND ORGANIC LIGHT-EMITTING DISPLAY

(75) Inventors: Chang Hwan Lee, Gumi-si (KR); Jin Huh, Gumi-si (KR)

(73) Assignee: LG. Display Co., Ltd., Seoul (KR)

( * ) Notice: Subject to any disclaimer, the term of this patent is extended or adjusted under 35 U.S.C. 154(b) by 666 days.

(21) Appl. No.: 11/302,921

(22) Filed: Dec. 14, 2005

(65) Prior Publication Data

US 2007/0001958 A1 Jan. 4, 2007

(30) Foreign Application Priority Data

Jun. 30, 2005 (KR) ..... 10-2005-0057507

(51) Int. Cl.
*G09G 3/32* (2006.01)

(52) U.S. Cl. ..... 345/82; 345/87; 345/55; 345/204

(58) Field of Classification Search ..... 345/82, 345/87, 204, 55
See application file for complete search history.

(56) References Cited

U.S. PATENT DOCUMENTS 6,483,493 B2 * 11/2002 Murade ..... 345/87
6,946,333 B2 * 9/2005 Green et al. ..... 438/154

* cited by examiner

*Primary Examiner*—Richard Hjerpe
*Assistant Examiner*—Leonid Shapiro
(74) *Attorney, Agent, or Firm*—Brinks Hofer Gilson & Lione

(57) ABSTRACT

An organic light-emitting device and an organic light-emitting display having the same are provided. The organic light-emitting device comprises: an organic light-emitting diode emitting light using an output current; a storage capacitor for receiving a data voltage from a data line, and storing the received data voltage; a driving thin film transistor connected between a source voltage and the organic light-emitting diode and having a gate connected to one terminal of the storage capacitor; a first switching unit connected between the one terminal of the storage capacitor and the data line and having a gate connected with a first scan line; a second switching unit connected between the other terminal of the storage capacitor and an initialization voltage line and having a gate connected with the first scan line; and a third switching unit connected between the other terminal of the storage capacitor and the data line and having a gate connected with a second scan line.

10 Claims, 10 Drawing Sheets

ORGANIC LIGHT-EMITTING DEVICE AND ORGANIC LIGHT-EMITTING DISPLAY

This application claims priority under 35 U.S.C. § 119(a) to Patent Application No. 10-2005-0057507 filed in Korea on Jun. 30, 2005, the entire contents of which are hereby incorporated by reference.

TECHNICAL FIELD

The present embodiments relate to an organic light-emitting device and an organic light-emitting display having the same.

DESCRIPTION OF THE BACKGROUND ART

An organic light-emitting diode (OLED) is an active light-emitting device in which light is emitted by recombination of electrons and holes and a phosphor is excited. An organic light-emitting display including the organic light-emitting diode can be used in wall mounted or portable displays owing to its fast response speed, low direct-current driving voltage, and ultra thinness, in comparison to a passive light-emitting device that uses a separate light source such as a liquid crystal display.

The organic light-emitting diode embodies a color using pixels in which red, green, and blue sub pixels are provided. In a method for driving the subpixels, the organic light-emitting diode can be classified as a passive matrix organic light-emitting diode (PMOLED), or an active matrix organic light-emitting diode (AMOLED) employing a driving method using a thin film transistor (TFT).

With respect to AMOLEDs, the thin film transistor has non-uniform device characteristics due to aspects of the TFT manufacturing process. For example, a polysilicon thin film transistor (p-si TFT) manufactured using an excimer laser to crystallize the silicon has non-uniform device characteristics that cause the power output to be unstable, i.e. the output current of the TFT varies even though the same data voltage provided to the TFT.

To compensate for the non-uniform characteristics, several driving methods have been suggested. These driving methods include a current driving method, a voltage driving method, and a digital driving method.

FIG. 1 is an equivalent circuit diagram illustrating a conventional current driving active matrix organic light-emitting device.

The conventional active matrix organic light-emitting device 10 that compensates for the non-uniformity of the thin film transistor comprises first to fourth thin film transistors (T1 to T4), a storage capacitor (Cst), and an organic light-emitting diode (OLED). The first to fourth thin film transistors (T1 to T4) comprise P-channel metal oxide semiconductor field effect transistors (MOSFET), and polysilicon thin film transistors (p-si TFT).

The organic light-emitting diode (OLED) emits light corresponding to the magnitude of the applied signal current ($I_{EL}$).

The first thin film transistor (T1) is connected between a source voltage (VDD) and the organic light-emitting diode (OLED), and supplies the signal current ($I_{EL}$) to the organic light-emitting diode (OLED).

The storage capacitor (Cst) is connected between the source voltage (VDD) and a gate of the first thin film transistor (T1) and stores the data voltage.

The second thin film transistor (T2) is connected between a gate and a drain of the first thin film transistor (T1), and has a gate connected to a first scan line. During the time period when the first scan signal is being applied to the second thin film transistor (T2) through the first scan line, the gate and the drain of the first thin film transistor (T1) becomes a common node, which allows the second thin film transistor to drive the first thin thin film transistor (T1).

The third thin film transistor (T3) is connected between the first thin film transistor (T1) and a current source (I), and has a gate connected to the first scan line. The third thin film transistor (T3) is in an ON state when the first scan signal is applied through the first scan line. This provides a current path for an output current (I) of the current source to store the storage capacitor (Cst) with a data voltage proportional to the output current (I).

The fourth thin film transistor (T4) is connected between the first thin film transistor (T1) and the organic light-emitting diode (OLED), and has a gate connected to a second scan line. The fourth thin film transistor is in an ON state when the second scan signal is applied through the second scan line so that a current is supplied to the organic light-emitting diode (OLED), thereby driving the organic light-emitting diode (OLED). During this time, the first scan signal is such that the second and the third thin film transistors (T2 and T3) are in OFF state.

Though the second and third thin film transistors (T2 and T3) are in OFF state, the data voltage proportional to the output current is stored in the storage capacitor (Cst), the first thin film transistor (T1) is driven by the data voltage, thereby supplying the signal current ($I_{EL}$) to the organic light-emitting diode (OLED).

In the conventional organic light-emitting diode (OLED), since the output current can be driven irrespective of the variations in the thin film transistor characteristics, non-uniformity in the luminance resulting from these variations can be compensated for.

In the conventional current compensation for organic light-emitting device 10, when a low gray level picture is displayed, the output current (I) is very low. The storage capacitor and the data line load are charged because the data line load acts as a parasitic capacitor on the data line, thereby removing current to adequately drive an OLED. Accordingly, the ability of an OLED to express a low gray level picture is diminished significantly. The deterioration of the capability to express a low gray level picture increases in seriousness in a large sized area where the data line load increases.

Thus, there is a need to provide an organic light-emitting device and organic light-emitting display that compensates for the variations in the thin film transistor characteristics, thereby making the luminance uniform, while preventing the deterioration of the ability of the OLED to express low gray levels.

BRIEF SUMMARY

By way of introduction only, an organic light-emitting device is presented that comprises: an organic light-emitting diode emitting light using an output current; a storage capacitor for receiving a data voltage from a data line and storing the received data voltage; a driving thin film transistor connected between a source voltage and the organic light-emitting diode and having a gate connected to a first terminal of the storage capacitor to supply the output current to the organic light-emitting diode using the data voltage stored in the storage capacitor; a first switching unit connected between the first terminal of the storage capacitor and the data line, the first switching unit having a control terminal connected with a first scan line to receive an input current from the data line by a first scan signal and transmit a control terminal voltage of the driving thin film transistor to the first terminal of the storage capacitor; a second switching unit connected between a second terminal of the storage capacitor and an initialization voltage line and having a control terminal connected with the first scan line to transmit an initialization voltage to the second terminal of the storage capacitor by the first scan signal; and a third switching unit connected between the second terminal of the storage capacitor and the data line and having a control terminal connected with a second scan line to transmit the data voltage to the second terminal of the storage capacitor through the second scan line.

In another aspect, the organic light-emitting device comprises: an organic light-emitting diode emitting light using an output current; a storage capacitor that receives a data voltage from a data line and stores the received data voltage; a driving thin film transistor connected between a source voltage and the organic light-emitting diode, the driving thin film transistor having a gate connected to a first terminal of the storage capacitor to supply the output current to the organic light-emitting diode using the data voltage stored in the storage capacitor; a first switching unit connected between the first terminal of the storage capacitor and an input current line, the first switching unit having a control terminal connected with a first scan line to receive an input current from the input current line by a first scan signal and transmit a control terminal voltage of the driving thin film transistor to the first terminal of the storage capacitor; and at least one switching unit connected between a second terminal of the storage capacitor and a line carrying an initialization voltage or the data voltage, the at least one switching unit having a control terminal connected with the first scan line or a second scan line to transmit the initialization voltage or the data voltage to the second terminal of the storage capacitor by the first scan signal or a second scan signal.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Preferred embodiments of the present invention will be described in a more detailed manner with reference to the drawings.

First Embodiment

Figure 2:
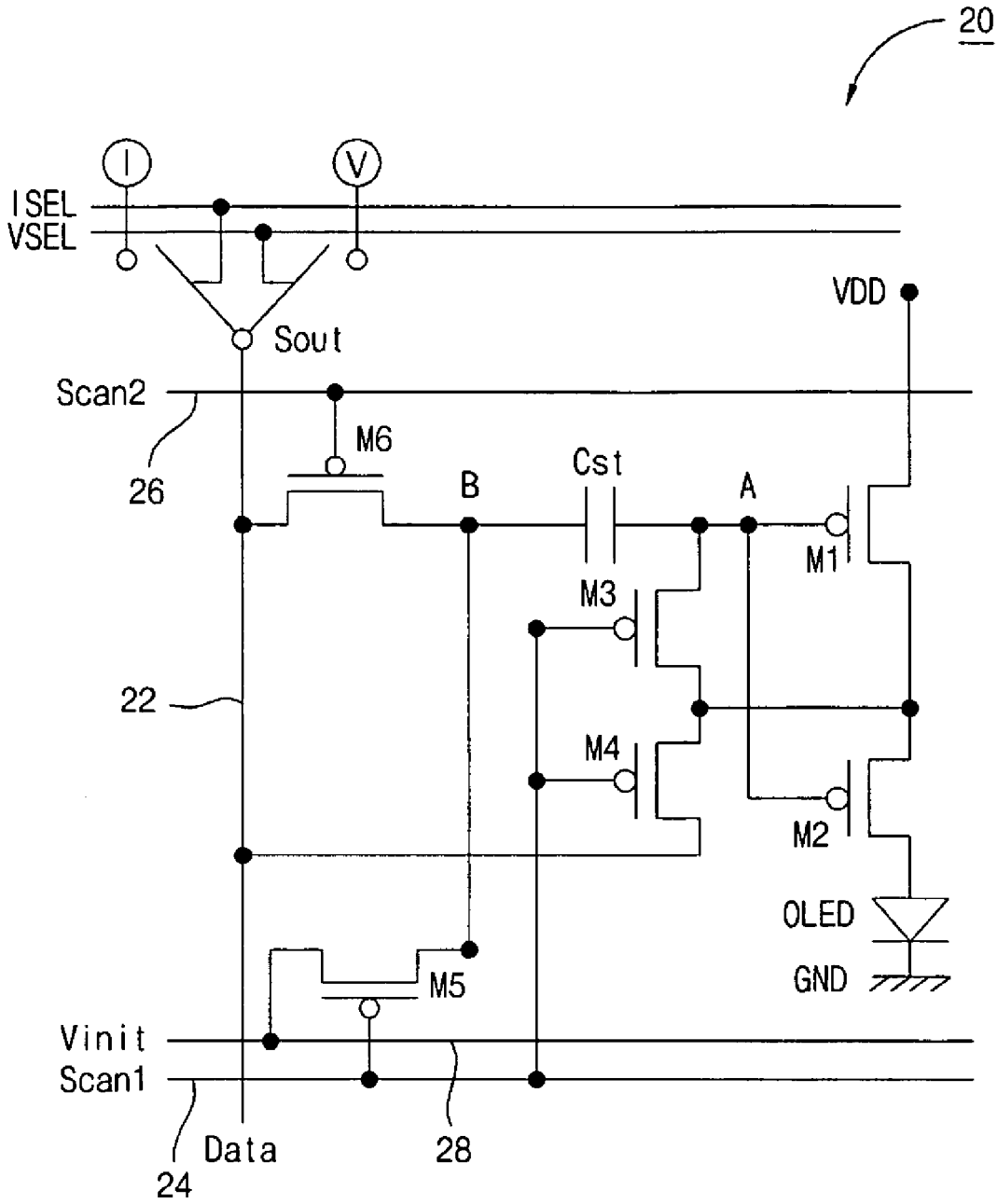
FIG. 2 is an equivalent circuit diagram of an organic light-emitting device according to the first embodiment of the present invention.
Figure 3:
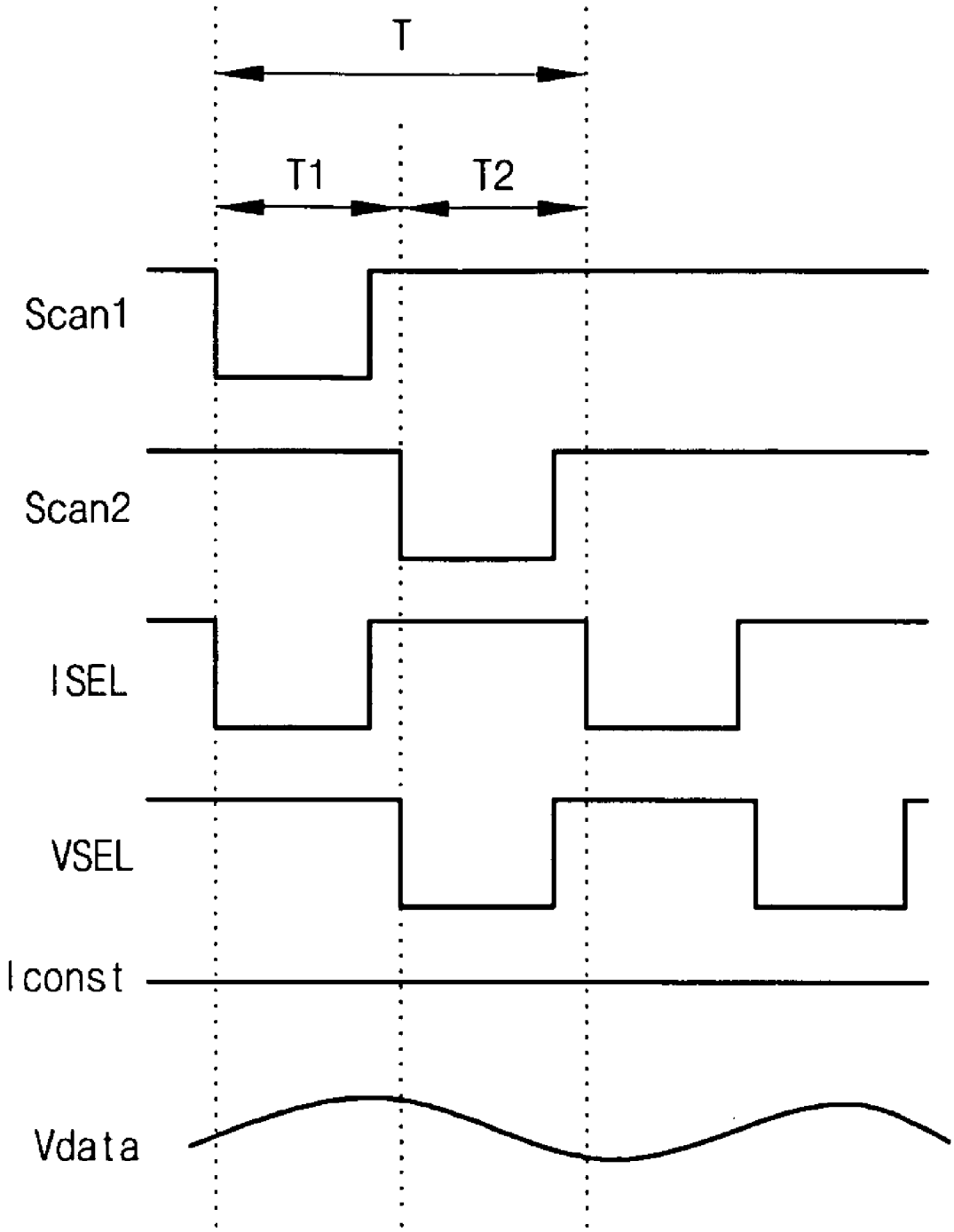
FIG. 3 is a driving timing diagram of FIG. 2.

FIG. 2 is an equivalent circuit diagram of an organic light-emitting device according to the first embodiment of the present invention, and FIG. 3 is a driving timing diagram of FIG. 2.

The active matrix organic light-emitting device 20 according to the first embodiment of the present invention comprises first to sixth thin film transistors (M1 to M6) which are P-type MOS transistors, a storage capacitor (Cst), and an organic light-emitting diode (OLED). Further, the organic light-emitting device 20 shown comprises a data line 22 for applying a data signal; first and second scan lines 24 and 26 for applying first and second scan signals respectively; and an initialization voltage line 28 for applying an initialization voltage.

The data signal is supplied by switching between a data voltage and a data current using an external selection switch (Sout) through one data line 22. A process of applying the data voltage or the data current to the inventive organic light-emitting device 20 in relation with applying of the first and second scan signals will be in detail described below.

The first thin film transistor (M1) is a driving thin film transistor, and the second to sixth thin film transistors (M2 to M6) are first to fifth switches. The storage capacitor (Cst) stores the data voltage applied through the data line. The organic light-emitting diode (OLED) emits light corresponding to the magnitude of the applied current.

The first and second thin film transistors (M1 and M2) are series connected between a source voltage (VDD) and the organic light-emitting diode (OLED). Gates of the first and second thin film transistors (M1 and M2) are connected to a node A with each other so that, when the first thin film transistor (Ml) is in an ON state, the second thin film transistor (M2) is in an ON state. Accordingly, a driving current of the first thin film transistor (M1) is supplied to the organic light-emitting diode (OLED) through the second thin film transistor (M2).

The third and fourth thin film transistors (M3 and M4) are series connected between the gates (node A) of the first and second thin film transistors (M1 and M2) and the data line 22. Gates of the third and fourth thin film transistors (M3 and M4) are connected to the first scan line 24 so that, when receiving the first scan signal through the first scan line 24, the third and fourth thin film transistors (M3 and M4) are in ON states, and apply the data signal or the data voltage applied through the data line 22, to the gates of the first and second thin film transistors (M1 and M2).

The fifth thin film transistor (M5) is connected between the initialization voltage line 28 and the storage capacitor (Cst), and its gate is connected with the first scan line 24. If the first scan signal is applied to the first scan line 24, the fifth thin film transistor (M5) is in an ON state, and applies the initialization voltage to one terminal (node B) of the storage capacitor (Cst) through the initialization voltage line.

The sixth thin film transistor (M6) is connected between the data line 22 and the storage capacitor (Cst), and its gate is connected with the second scan line 26. If the second scan signal is applied to the second scan line, the sixth thin film transistor (M6) is in an ON state, and applies the data signal or the data voltage to the one terminal (node B) of the storage capacitor (Cst).

The storage capacitor (Cst) is connected between the gates of the first and second thin film transistors (M1 and M2) and the sixth thin film transistor (M6), that is, between the node A and the node B.

Hereinafter, an operation of the active matrix organic light-emitting device 20 according to the first embodiment of the present invention will be described with reference to FIGS. 2 and 3. FIG. 3 is the driving timing diagram of FIG. 2.

Referring to FIGS. 2 and 3, in a period of $T_1$ of FIG. 3, the first scan signal is applied through the first scan line 24, and the data current is applied through the data line 22, thereby current driving the organic light-emitting device 20 according to the first embodiment of the present invention.

The application of the first scan signal causes the third to fifth thin film transistors (M3 to M5) to be in ON states and accordingly, the data current (ISEL) is applied to the organic light-emitting device 20 and the initialization voltage (Vinit) is applied to the node B. In a state where node B is initialized to the initialization voltage (Vinit), the data current (ISEL) determines the specific voltage ($V_A$) in node A.

As the node A is driven by the current driving pixel structure, the variations in threshold voltage (Vth) or mobility of a driving device do not affect node A, thereby improving compensation of the non-uniform characteristics of the TFT. An input current ($I_{CONST}$) can be applied to charge the data line load sufficiently and therefore avoids the problem of charging a data line load that results in a low gray level current, which is problematic in the conventional current compensation pixel structure. The input current ($I_{CONST}$) is expressed as in Equation 1 and accordingly, a gate-source voltage ($V_{GS}$) of the first thin film transistor (M1) is expressed as in Equation 2 obtained by arranging the Equation 1:

$$I_{CONST} = \frac{\beta}{2}(V_{GS} - V_{TH})^2 \quad \text{[Equation 1]}$$

$$V_{GS} = V_A = \sqrt{\frac{2I_{CONST}}{\beta}} + V_{TH} \quad \text{[Equation 2]}$$

where, $I_{CONST}$ is input current, $\beta$ is constant, $V_{GS}$ is gate-source voltage $V_{TH}$ is threshold voltage, and $V_A$ is voltage of node A during period of $T_1$.

In period $T_2$ of FIG. 3, the first scan signal and the data current become high and the second scan signal is applied through the second scan line 26, and the data voltage is applied through the data line 22, thereby voltage driving the organic light-emitting device 20 according to the first embodiment of the present invention.

Figure 1:
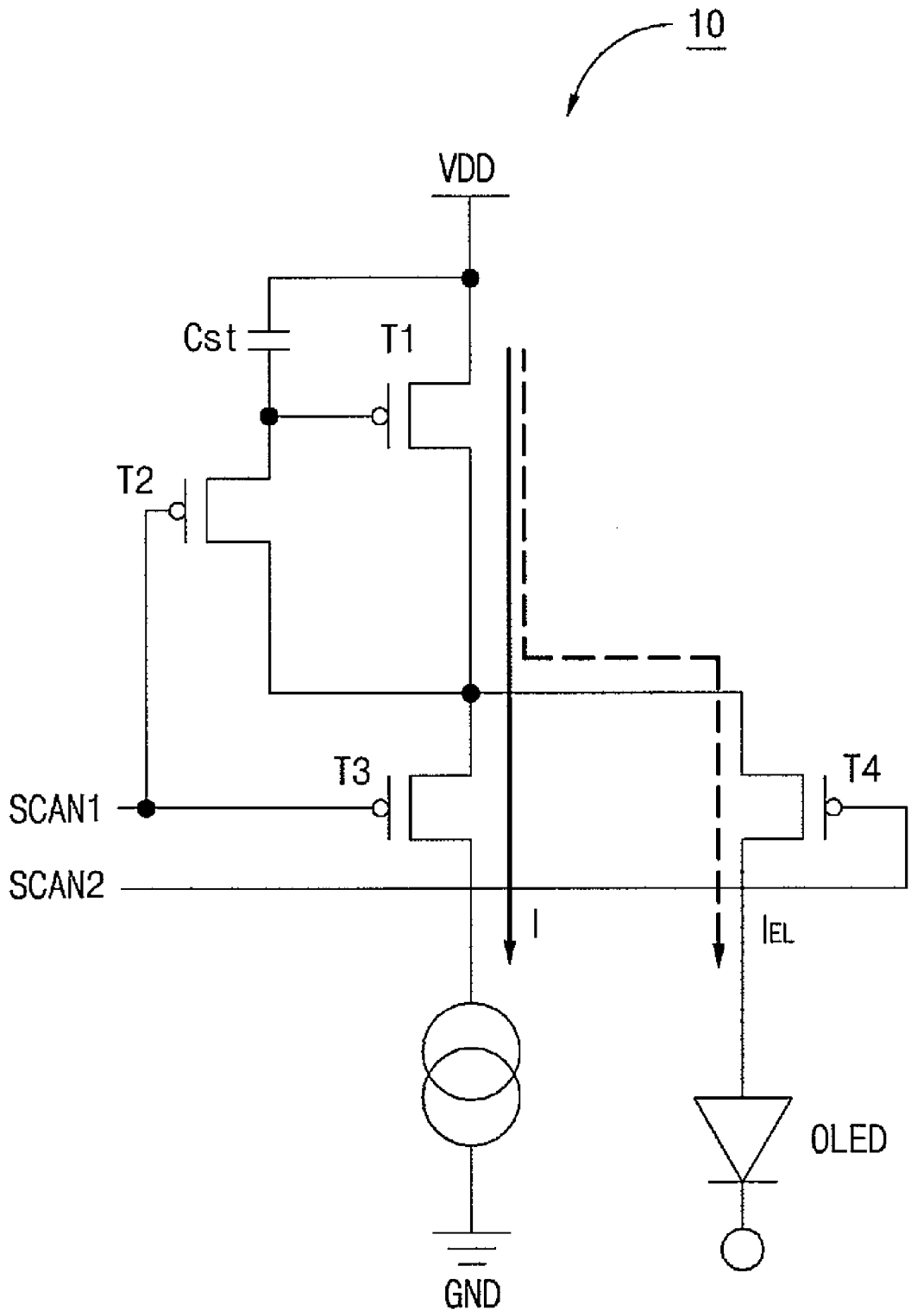
Fig. 1 RELATED ART
FIG. 1 is an equivalent circuit diagram of a conventional current driving active matrix organic light-emitting device.

The application of the second scan signal causes the sixth thin film transistor (M6) to be in an ON state and then allows the data voltage (Vdata) to charge the node B. The node B varies by a voltage of (data voltage−initialization voltage) (Vdata−Vinit), and the node A also varies by a voltage of (data voltage−initialization voltage) (Vdata−Vinit) so that the voltage in node A is obtained by a sum of a voltage determined through the current driving and the voltage of (data voltage−initialization voltage) (Vdata−Vinit). As a result, the voltage in the node A turns the gate of the first and second thin film transistors (M1 and M2) to the on state thereby supplying an output current ($I_{OLED}$) of Equation 3 corresponding to the voltage of the node A, to the organic light-emitting diode (OLED), and enabling the organic light-emitting diode (OLED).

$$I_{OLED} = \frac{\beta}{2}\left[\sqrt{\frac{2I_{CONST}}{\beta}} + (V_{DATA} - V_{INIT})\right]^2 \quad \text{[Equation 3]}$$

where, $I_{OLED}$ is output current, $V_{DATA}$ is data voltage applied in period of $T_1$, $V_{INIT}$ is initialization voltage, and Other symbols are the same as those of FIGS. 1 and 2.

As shown in the Equation 3, in the output current ($I_{OLED}$) supplied to the organic light-emitting diode (OLED), the threshold voltage (Vth) term is no longer present. Thus, the variation of the threshold voltage is compensated.

If the data voltage ($V_{DATA}$) applied is the same as the initialization voltage ($V_{INIT}$) then the input current ($I_{CONST}$) and the output current ($I_{OLED}$) are the same, thereby compensating the device characteristic.

In one embodiment, the input current ($I_{CONST}$) is more than the minimum current to charge the data line load during the period of $T_1$ of FIG. 3. Preferably, the input current corresponds to a middle gray level as, in the evaluation of picture quality, deterioration of the picture quality resulting from the variation of the device characteristic is best shown at the middle gray level.

Around the middle gray level, the voltage of (Vdata−Vinit) is smaller than the voltage of other gray levels and accordingly, a current difference resulting from the variation of the mobility also is smaller.

Figure 4:
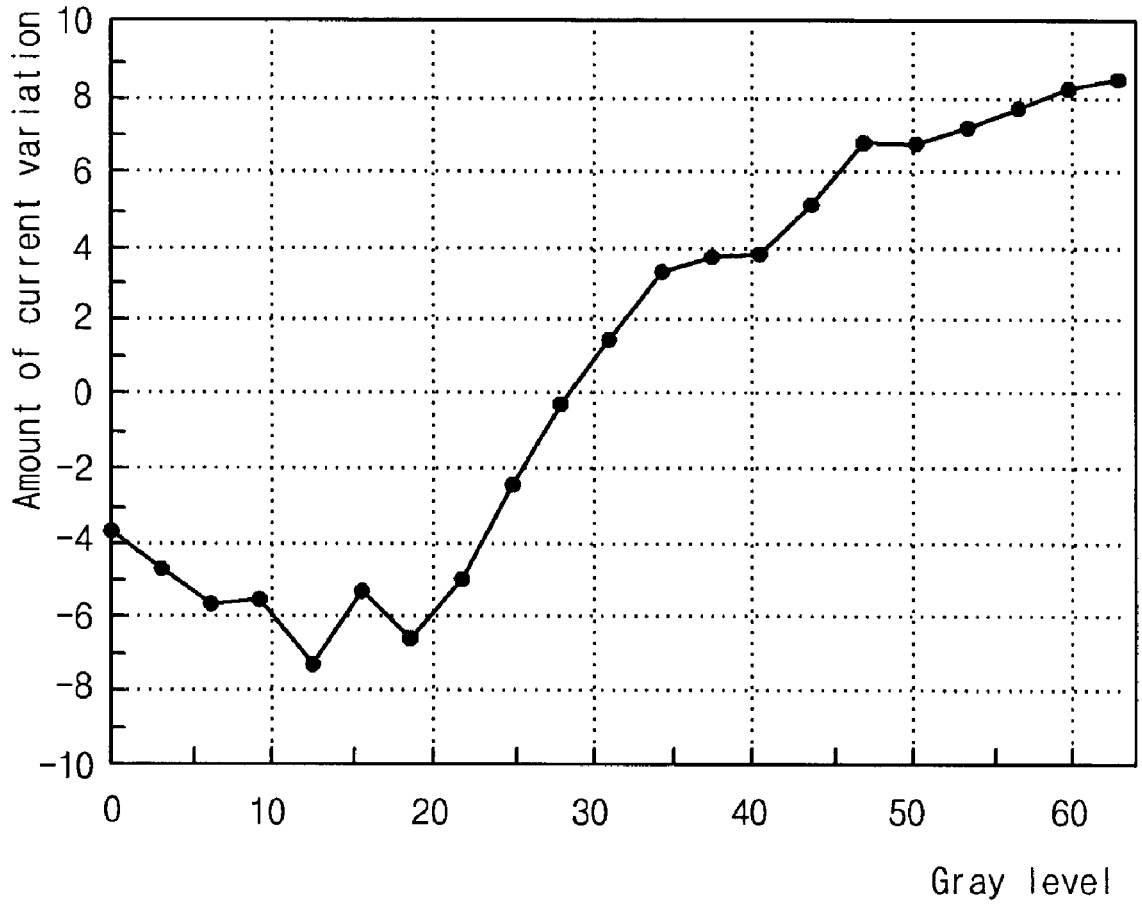
FIG. 4 is a graph illustrating a current difference depending on a gray level of FIG. 2.

FIG. 4 is a graph illustrating the current difference depending on the gray level of FIG. 2. The difference of current is as shown in Equation 4.

As shown in FIG. 4, the difference of current is almost zero at the middle gray level. This is smaller than the current difference of a conventional pixel structure even at both higher and lower gray levels.

$$\text{Current difference} = \frac{I_{60} - I_{50}}{I_{60}} \quad \text{[Equation 4]}$$

Second Embodiment

Figure 5:
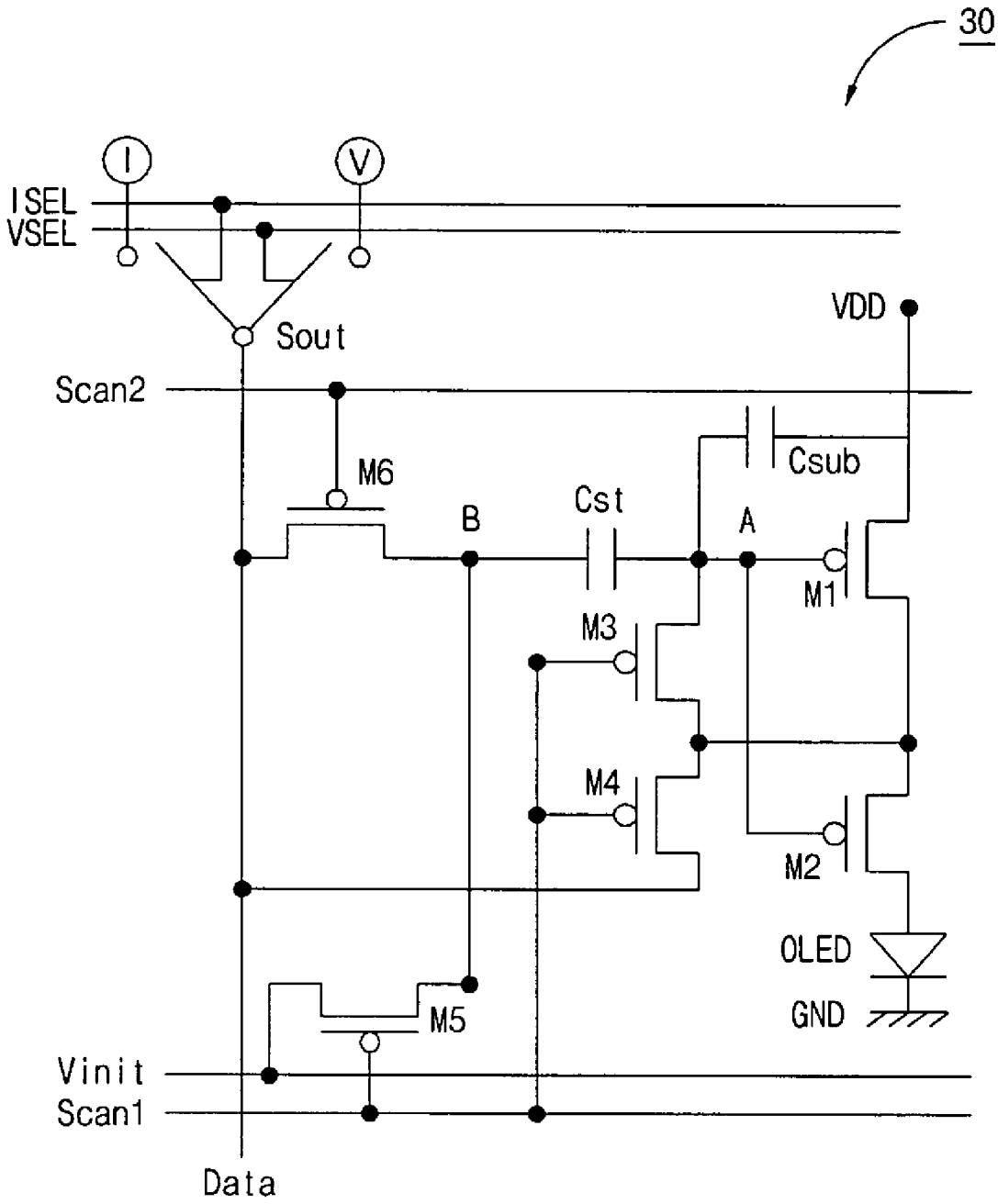
FIG. 5 is an equivalent circuit diagram of an organic light-emitting device according to the second embodiment of the present invention.

FIG. 5 is an equivalent circuit diagram of an organic light-emitting device according to the second embodiment of the present invention.

The organic light-emitting device 30 according to the second embodiment of the present invention is the same as the organic light-emitting device 20 according to the second embodiment of the present invention, excepting that a subsidiary capacitor (Csub) is provided between the source and the gate of the first thin film transistor (M1).

The subsidiary capacitor (Csub) is disposed between the source and the gate of the first thin film transistor (M1) to reduce a leakage current of a voltage of a node A.

When a data voltage (Vdata) is applied in period $T_2$ of FIG. 3, the voltage ($V_A$) of the node A is as in Equation 5 below:

$$V_A = (V_{data} - V_{init})\frac{C_{st}}{C_{st} - C_{sub}} \quad \text{[Equation 5]}$$

When the data voltage is applied in the period of $T_2$ of FIG. 3, a voltage of a node B (Vdata−Vinit) is branched between a storage capacitor and the subsidiary capacitor so that only the same voltage as the Equation 5 increases at the node A. Therefore, in the organic light-emitting device 30, in expression of the same gray level, the data voltage (Vdata) is greater in magnitude than that of the organic light-emitting device 20 according to the first embodiment of the present invention.

Third Embodiment

Figure 6:
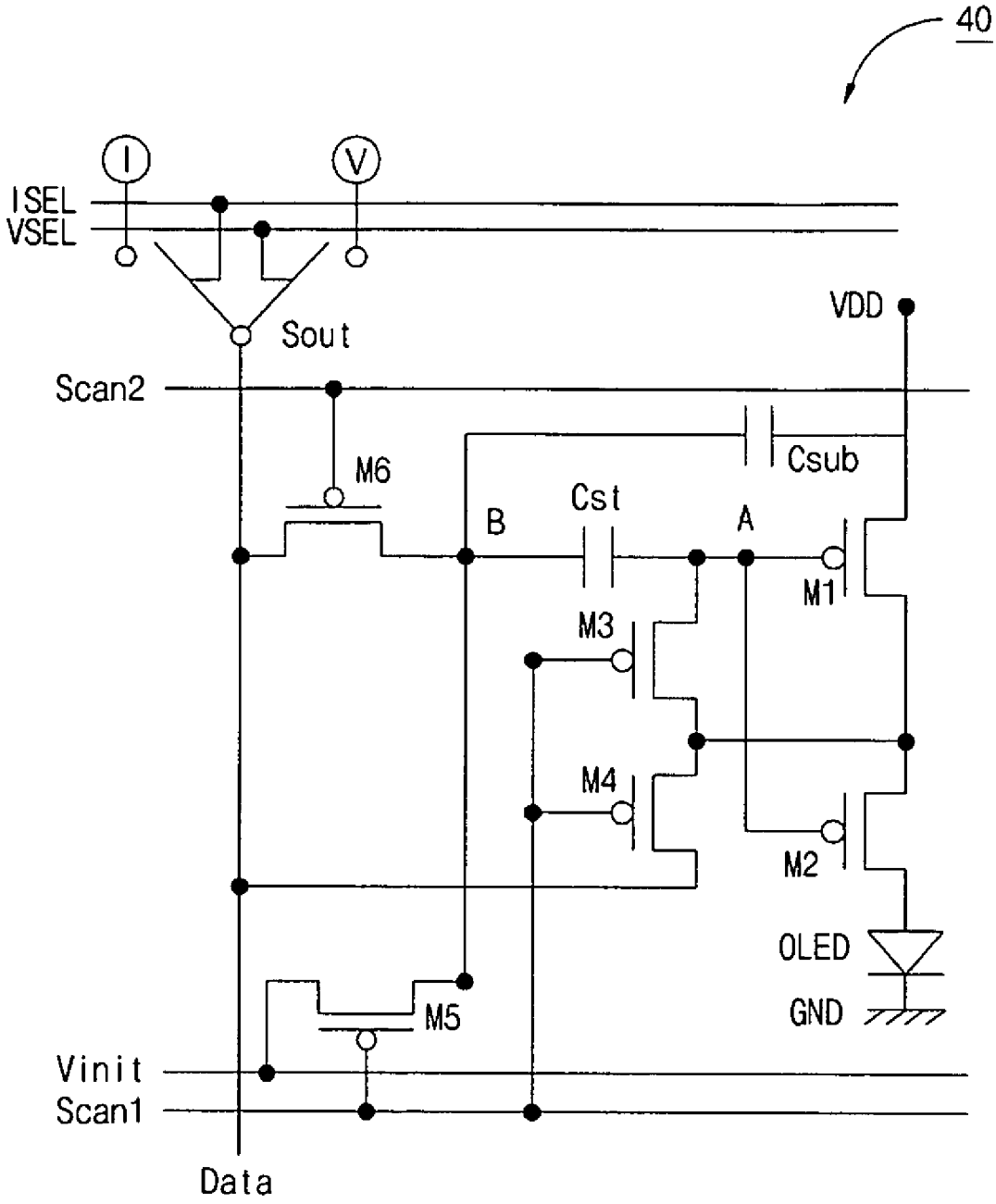
FIG. 6 is an equivalent circuit diagram of an organic light-emitting device according to the third embodiment of the present invention.

FIG. 6 is an equivalent circuit diagram of an organic light-emitting device according to the third embodiment of the present invention.

Referring to FIG. 6, the organic light-emitting device 40 according to the fourth embodiment of the present invention is the same as the organic light-emitting devices 20 and 30 of the first and second embodiments of the present invention, excepting that a subsidiary capacitor (Csub) is disposed additionally between the source of the first thin film transistor (M1) and the sixth thin film transistor (M6).

Fourth Embodiment

Figure 7:
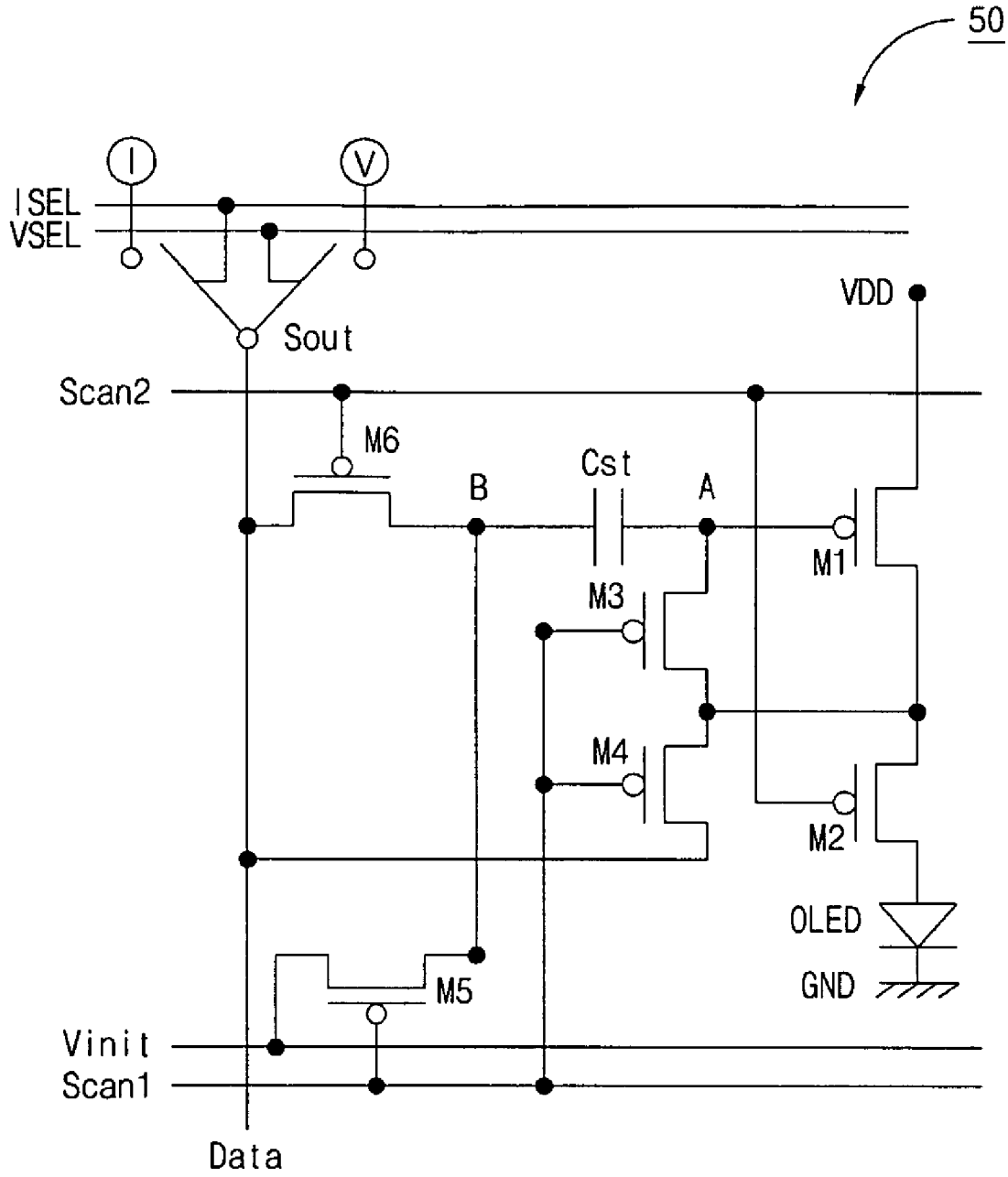
FIG. 7 is an equivalent circuit diagram of an organic light-emitting device according to the fourth embodiment of the present invention.

FIG. 7 is an equivalent circuit diagram of an organic light-emitting device according to the fourth embodiment of the present invention.

Referring to FIG. 7, the organic light-emitting device 50 according to the fourth embodiment of the present invention is the same as the organic light-emitting device 20 according to the first embodiment of the present invention, excepting that the second thin film transistor (M2) comprises an N-type MOS transistor whose gate is connected to the second scan line 26 rather than node A.

The N-type MOS transistor may be used as the second thin film transistor (M2) to more sufficiently supply the output current to the organic light-emitting diode (OLED) in comparison with a P-type MOS transistor.

Fifth Embodiment

Figure 8:
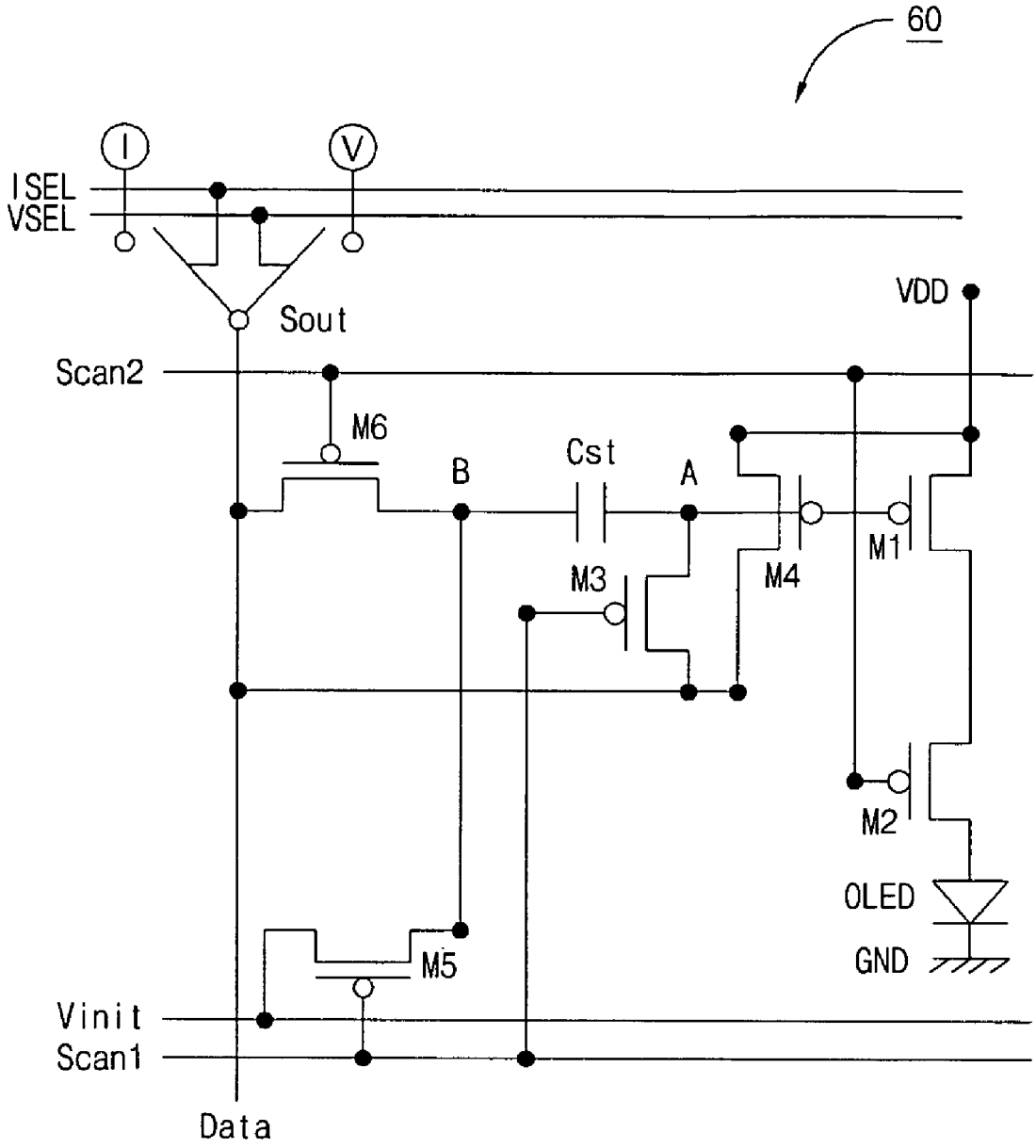
FIG. 8 is an equivalent circuit diagram of an organic light-emitting device according to the fifth embodiment of the present invention.

FIG. 8 is an equivalent circuit diagram of an organic light-emitting device according to the fifth embodiment of the present invention.

Referring to FIG. 8, the organic light-emitting device 60 according to the fifth embodiment of the present invention is the same as the organic light-emitting device 20 according to the first embodiment of the present invention, excepting that gates of first and fourth thin film transistors (M1 and M4) are commonly connected to a node A in a mirror structure, and the fourth thin film transistor (M4) is connected between the third thin film transistor (M3) and the source voltage (VDD).

Since the first and fourth thin film transistors (M1 and M4) are combined in a mirror structure, a threshold voltage of the first thin film transistor (M1) can be compensated.

Through the fifth embodiment, it can be appreciated that the present invention provides various pixel structures that are primarily current driven.

Sixth Embodiment

Figure 9:
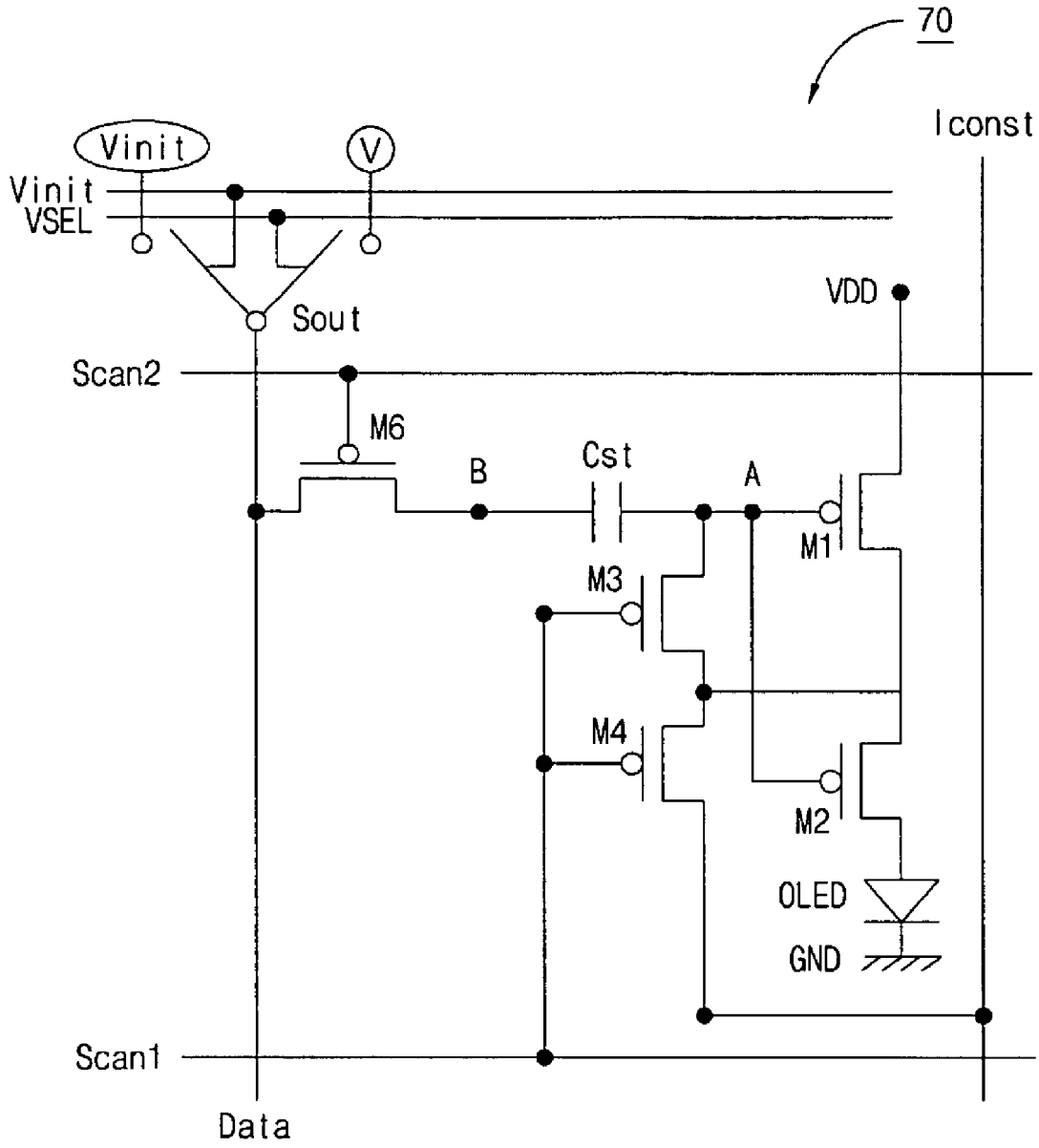
FIG. 9 is an equivalent circuit diagram of an organic light-emitting device according to the sixth embodiment of the present invention.

FIG. 9 is an equivalent circuit diagram of an organic light-emitting device according to the sixth embodiment of the present invention.

Referring to FIG. 9, the organic light-emitting device 70 according to the sixth embodiment of the present invention is different from the organic light-emitting device 20 according to the first embodiment of the present invention, in that the initialization voltage (Vinit) and the data voltage (Vdata) are selectively supplied through the data line, and the input current ($I_{CONST}$) is supplied to the fourth thin film transistor (M4) using a separate line.

Accordingly, the fifth thin film transistor switching the initialization voltage (Vinit) for the fourth thin film transistor (M4) is not present, thereby reducing the number of transistors compared to the first through fifth embodiments.

Figure 10:
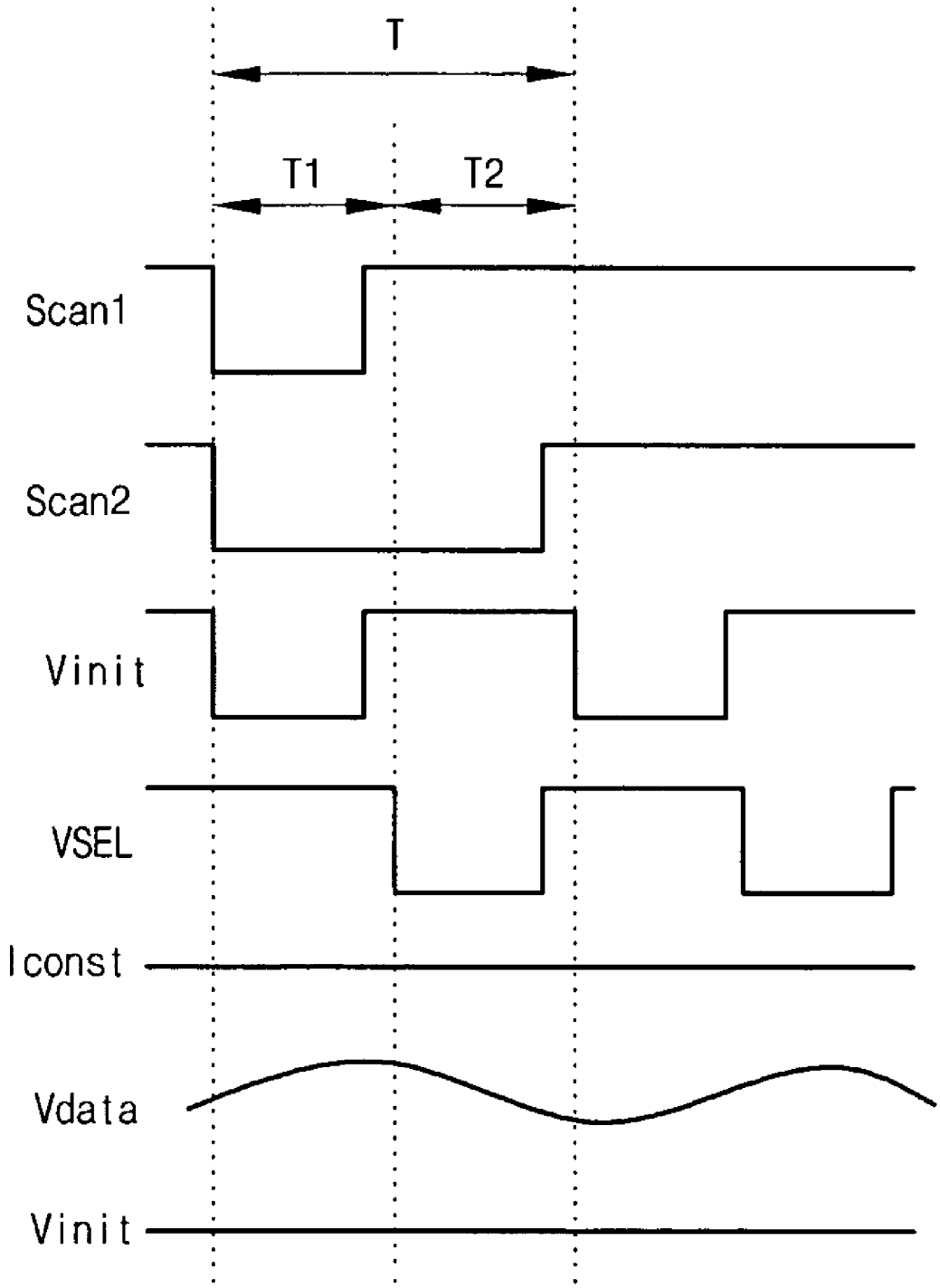
FIG. 10 is a driving timing diagram of FIG. 9.

FIG. 10 is a driving timing diagram of FIG. 9.

Referring to FIG. 10, the first and second scan signals are applied to the third and fourth thin film transistors (M3 and M4) and the sixth thin film transistor (M6) respectively, through first and second scan lines during the period $T_1$ and concurrently, the initialization voltage is applied through the data line. During the period $T_1$, the gate voltage is formed at node A by the input current, and the initialization voltage is applied to the node B.

During period $T_2$, only the second scan signal is applied to the sixth thin film transistor (M6) through the second scan line and concurrently the data voltage is applied to node A through the data line. During the period $T_2$, the node B has a voltage of (data voltage−initialization voltage), thereby performing the same operation as the organic light-emitting device 20 according to the first embodiment of the present invention.

Through the above construction, variations in the driving thin film transistor characteristics are compensated, thereby increasing uniformity of the luminance while simultaneously permitting the low gray levels to be adequately expressed.

The invention being thus described may be varied in many ways. Such variations are not to be regarded as a departure from the spirit and scope of the invention, and all such modifications as would be obvious to one skilled in the art are intended to be included within the scope of the following claims.

What is claimed is:

1. An organic light-emitting device comprising:

an organic light-emitting diode emitting light using an output current;

a storage capacitor that receives a data voltage from a data line and stores the received data voltage;

a driving thin film transistor connected between a source voltage and the organic light-emitting diode and having a gate connected to a first terminal of the storage capacitor to supply the output current to the organic light-emitting diode using the data voltage stored in the storage capacitor;

a first switching unit connected between the first terminal of the storage capacitor and the data line, the first switching unit having a control terminal connected with a first scan line to receive an input current from the data line by a first scan signal and transmit a control terminal voltage of the driving thin film transistor to the first terminal of the storage capacitor;

a second switching unit connected between a second terminal of the storage capacitor and an initialization voltage line and having a control terminal connected with the first scan line to transmit an initialization voltage to the second terminal of the storage capacitor by the first scan signal; and a third switching unit connected between the second terminal of the storage capacitor and the data line and having a control terminal connected with a second scan line to transmit the data voltage to the second terminal of the storage capacitor through the second scan line.

2. The device of claim 1, further comprising a fourth switching unit connected between the driving thin film transistor and the organic light-emitting diode, the fourth switching unit having a control terminal connected to the gate of the driving thin film transistor to switch the output current supplied from the driving thin film transistor to the organic light-emitting diode.

3. The device of claim 2, wherein the driving thin film transistor and the first to fourth switching units comprise P-type MOS transistors.

4. The device of claim 1, further comprising a fourth switching unit connected between the driving thin film transistor and the organic light-emitting diode, the fourth switching unit having a control terminal connected to the second scan line to switch the output current supplied from the driving thin film transistor to the organic light-emitting diode, wherein the driving thin film transistor and the first to third switching units comprise P-type MOS transistors, and the fourth switching unit comprises an N-type MOS transistor.

5. The device of claim 1, wherein the first switching unit comprises series connected P-type MOS transistors between the first terminal of the storage capacitor and the data line, the series connected transistors each having a gate connected with the first scan line.

6. The device of claim 1, further comprising a P-type MOS transistor connected between the data line and the source voltage, the P-type MOS transistor having a gate connected with the gate of the driving thin film transistor to form a mirror structure with the first switching unit.

7. The device of claim 1, further comprising a subsidiary capacitor connected between the source voltage and the first terminal of the storage capacitor.

8. The device of claim 1, further comprising a subsidiary capacitor connected between the source voltage and the second terminal of the storage capacitor.

9. An organic light-emitting display comprising:

a scan driver connected with first and second scan lines and supplying first and second scan signals;

a data driver connected with a data line and supplying a data voltage;

an organic light-emitting device claimed in claim 1, disposed at an intersection of the first and second scan lines and the data line;

an input current driver connected with the data line and supplying an input current through the data line;

a selection switch for transmitting the input current and the data voltage to the data line in synchronization with the first and second scan signals; and an initialization voltage source connected with an initialization voltage line and supplying an initialization voltage.

10. The display of claim 9, wherein the organic light-emitting device further comprises a fourth switching unit connected between a driving thin film transistor and an organic light-emitting diode and having a control terminal connected to a gate of the driving thin film transistor to transmit an output current supplied from the driving thin film transistor to the organic light-emitting diode.

* * * * *